United States Patent [19]

Vadnais

[11] 4,273,275

[45] Jun. 16, 1981

[54] TOY ACCESSORY

[75] Inventor: Kenneth Vadnais, Livonia, Mich.

[73] Assignee: S & S Industries, Inc., Wyandotte, Mich.

[21] Appl. No.: 30,832

[22] Filed: Apr. 17, 1979

[51] Int. Cl.[3] ..... A63H 1/30

[52] U.S. Cl. ..... 224/101; 46/61; 224/217

[58] Field of Search ..... 224/217–221, 224/267, 101; 46/61, 77; 244/153 R, 155 R, 155 A

[56] References Cited

U.S. PATENT DOCUMENTS

| | | | |
|---|---|---|---|
| 1,793,151 | 2/1931 | Asbury et al. | 46/61 |
| 1,864,318 | 6/1932 | Powell | 46/61 |
| 3,545,124 | 12/1970 | Schwartz | 46/61 |
| 3,747,171 | 7/1973 | Montague, Jr. | 224/176 X |
| 3,854,640 | 12/1974 | Willmarth | 224/220 |

*Primary Examiner*—Stephen Marcus

*Attorney, Agent, or Firm*—Fisher, Gerhardt, Crampton & Groh

[57] ABSTRACT

The invention comprises an improved ring and swivel combination for attaching a toy such as a Yo-Yo or spinning top to the operator's finger. The ring includes a flexible strap for adjustable attachment to the finger. Preferably the strap comprises a portion of woven hooks and a complementary portion of woven loops such as that sold under the VELCRO trademark. The swivel comprises a cup attached to the strap and having a carefully formed hole in the cup bottom. The string attached to the toy passes through the hole and is knotted inside the cup. The knotted string and cup forms an effective swivel to prevent wind-up of the Yo-Yo or spinning top string.

The toy accessory may be used to control model race cars and model airplanes by using a pair of toy accessories attached to two fingers to replace the conventional dual control handle. The swivels allow the operator to guide the model in a circular patch without turning around to prevent wind-up of the pair of guide lines.

The toy accessory is also applicable to simple fishing kits that consist of a hook, line and sinker, the line merely being held in the hand. With the toy accessory the fishing line is conveniently attached to a finger or a wrist.

3 Claims, 7 Drawing Figures

TOY ACCESSORY

BACKGROUND OF THE INVENTION

The field of the invention pertains to toys and sporting goods and in particular to accessories for toys such as Yo—Yo's and spinning tops that can be guided by the operator.

The typical Yo—Yo or spinning top includes a string attached at one end to the toy and having a loop at the other end for the operator's finger. As the toy is operated the string tends to wind up eventually interfering with control of the toy and the pleasure experienced from the toy. The string wind-up causes the loop to shrink on the operator's finger eventually pinching and cutting off blood circulation with resultant discomfiture.

In order to overcome the wind-up problem, swivels have been incorporated in the attachment of the string to the operator's finger. U.S. Pat. Nos. 1,864,318 and 2,773,328 disclose swivels attached to rings or handles to prevent wind-up. The swivels and attachments to the string tend to interfere with the operation of the toy as it approaches the operator's finger and to complicate an otherwise very simple attachment of the string to the operator's finger. U.S. Pat. No. 3,545,124 discloses a specialized handle with one or more sockets for grasping a Yo—Yo. Pat. No. 2,071,041 discloses a lariat type of toy with a handle having a swivel connection to the lariat rope. Despite the above disclosures a simple more effective swivel attachment is needed.

SUMMARY OF THE INVENTION

The invention comprises an improved ring and swivel combination for attaching a toy such as a Yo—Yo or spinning top to the operator's finger. The ring includes a flexible strap for adjustable attachment to the finger. Preferably the strap comprises a portion of woven hooks and a complementary portion of woven loops such as that sold under the VELCRO trademark. The swivel comprises a cup or rigid ring attached to the strap and having a carefully formed hole in the cup bottom or side wall of the rigid ring. The string attached to the toy passes through the hole and is knotted inside the cup. The knot in the string and the cup forms an effective swivel to prevent wind-up of the Yo—Yo or spinning top string. The cup or rigid ring prevents contact of the knot with the operator's finger which would otherwise impair the swiveling action of the knot.

The hole is carefully shaped to prevent wear and cutting of the string with extended use. The hole shape also facilitates assembly of the string to the cup when assembling the string to the toy accessory or when replacing the string.

The toy accessory may be used to control model race cars and model airplanes by using a pair of toy accessories attached to two fingers to replace the conventional dual control handle. The swivels allow the operator to guide the model in a circular path without turning around to prevent wind-up of the pair of guide lines. The toy accessory is also applicable to simple fishing kits that consist of a hook, line and sinker, the line merely being held in the hand. With the toy accessory the fishing line is conveniently attached to a finger or or a wrist. With wrist attachment the hand is left free for other uses.

DESCRIPTION OF THE PREFERRED EMBODIMENTS

Figure 1:
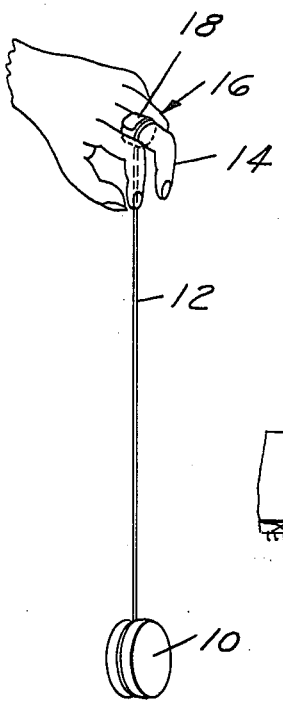
FIG. 1 is a perspective view of the toy accessory in use with a Yo—Yo.

In FIG. 1 a Yo—Yo 10 and Yo—Yo string 12 are shown attached to a finger 14. A toy accessory generally denoted by 16 is shown attached to the finger and in turn attaching the string 12 to the finger. The Yo—Yo is operated in the conventional manner and may be attached to another finger.

Figure 2:
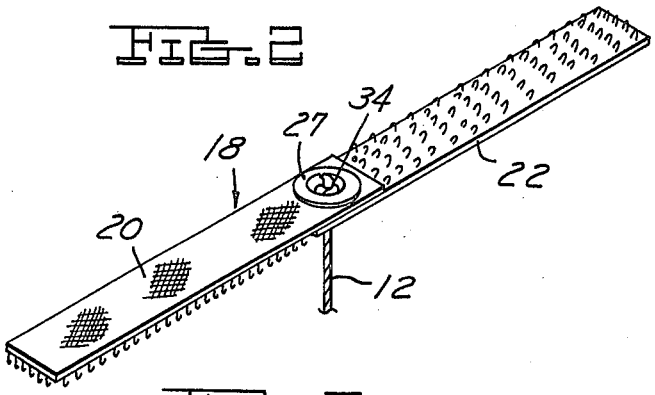
FIG. 2 is a perspective view of the toy accessory.

As shown in FIG. 2 the toy accessory comprises a flexible woven strap generally denoted by 18 consisting preferably of two complementary portions, a hooked portion 20 and a looped portion 22. The complementary portions 20 and 22 are suitably pieces of material sold under the VELCRO trademark. Reference is made to U.S. Pat. No. 2,717,437 issued Sept. 13, 1955 for a more detailed disclosure of the VELCRO components.

Figure 3:
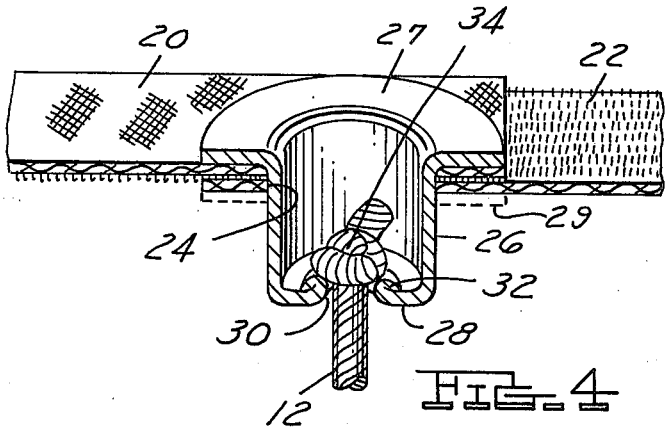
FIG. 3 is a partial cross section of the toy accessory.

As best shown in FIG. 3 the hooked portion 20 and looped portion 22 are joined together and pierced by an aperture 24 into which is inserted a small metal cup 26 having a flange 27. Adhesive applied to the outside of the cup 26 assures that the strap portions and cup will be permanently attached together upon assembly. The bottom 28 of the cup 26 is pierced by a carefully formed hole 30. The hole 30 is basically conical or funnel shaped from the exterior of the cup and rolled inwardly at 32. A knot 34 is tied in the string and in combination with the hole 30 in the cup bottom 28 forms a very effective swivel. The conical or funnel shape facilitates insertion of the string 12 through the hole when initially assembled and when the string is to be replaced. The rolled inward shape of the hole 30 prevents the thin metal of the cup 26 from cutting the string as it turns in the hole. In use the strap 18 is wrapped about the finger with the cup 26 underneath as best shown in FIG. 1. The cup prevents the finger from interfering with the free rotation of the knot.

FIGS. 2 and 3 are greatly enlarged to disclose the construction of the toy accessory. In actual practice the strap 18 is about $\frac{3}{8}$ inch wide and 3 inches long. The cup depth and diameter not including the flange are approximately 3/16 inch and the hole 30 diameter less than 1/16 inch. The metal cup thickness is less than 1/64 inch. As an alternative means of fastening the cup 26 to the strap 18, a metal ring 29 may be press fit about the cup barrel and against the strap as shown ghosted at 29 in FIG. 3.

The configuration eliminates the need for a separate two part swivel and the conical aperture of the hole 30 permits easy insertion of the string 12 and the tying of a simple knot by the sometimes clumsy fingers of a young child.

Figure 4:
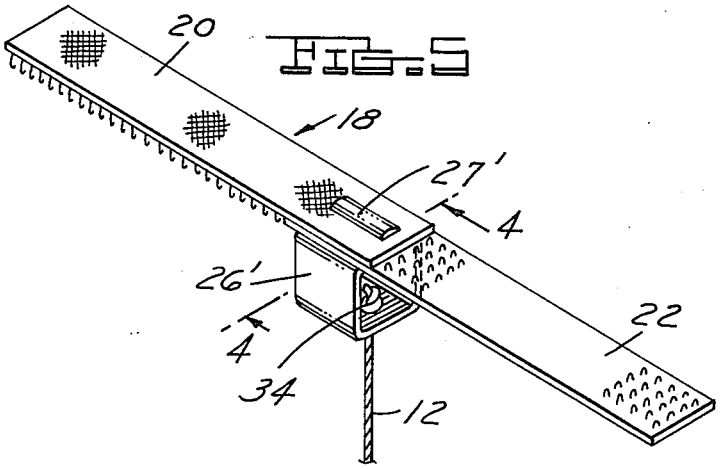
FIG. 4 is a partial cross section of an alternative form of the toy accessory.
Figure 5:
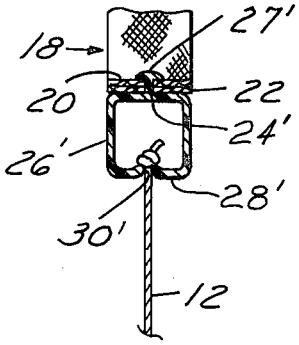
FIG. 5 is a perspective view of the alternative form of the toy accessory.

In FIGS. 4 and 5 an alternate embodiment of the toy accessory is shown. As above the strap 18 consists of two complementary VELCRO pieces 20 and 22 joined together such that they can be wrapped about a finger and fastened. In this embodiment the aperture 24' is generally rectangular and parallel to the length of the strap. Extending below the strap 18 is a ring 26' of rigid material such as hard plastic. The top of the ring 26' is generally flat adjacent the strap 18 and includes a rectangular stud 27' extending through the rectangular aperture 24'. The stud 27' is heat swaged over the strap 18 after assembly.

The bottom 28' of the ring 26' is pierced by a small hole 30' through which is inserted a string 12. The string is knotted 34' as above. The hole 30' is funnel or conical shaped from the outside as above to provide ease of insertion of the string 12. A suitable means of forming the hole 30' is to punch with a hot needle of proper shape to create the funnel shape and smooth inward roll in the rigid plastic of the ring. The alternative shown in FIGS. 4 and 5 permits the rigid ring 26' portion of the swivel to be made from a slice of an extruded plastic shape with only the additional operation of hot punching the hole 30' before assembly to the strap 18.

Figure 6:
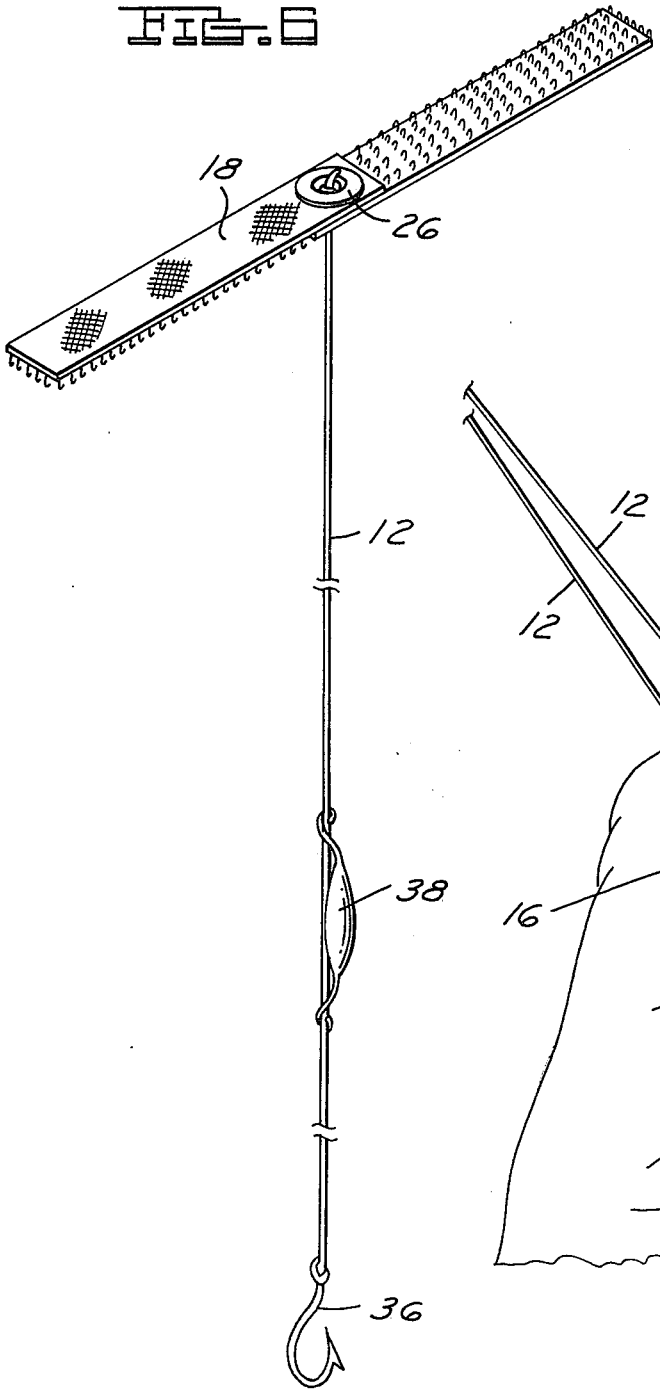
FIG. 6 is a perspective view of the toy accessory attached to a hook, line and sinker; and, FIG. 7 is a perspective view of a pair of toy accessories attached to a hand.
Figure 7:
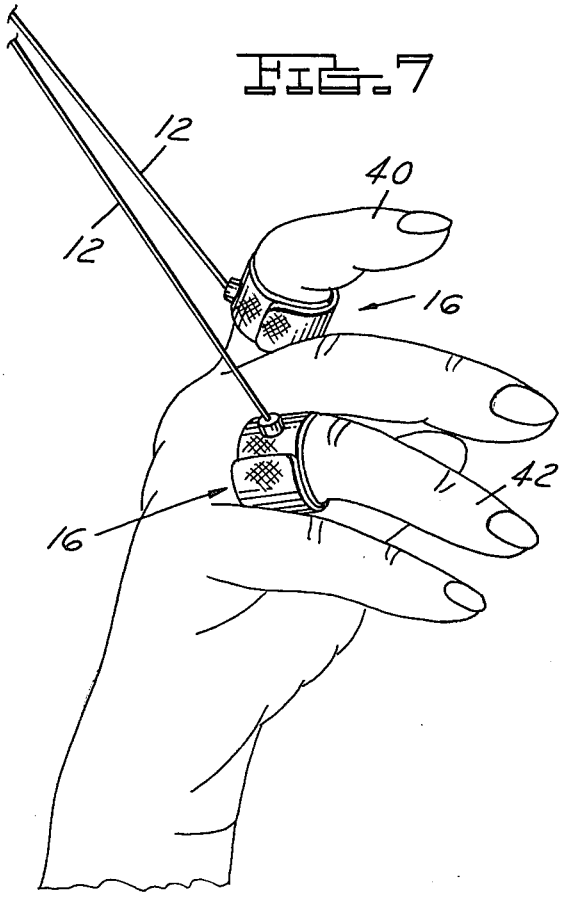

FIGS. 6 and 7 disclose alternative uses for the toy accessory. In FIG. 6 the toy accessory is part of a fishing kit also comprising a hook 36 and sinker 38 attached to the line or string 12. Such kits are sold to be conveniently carried in a pocket or automobile glove compartment and the fisherman merely holds onto the line with his hand. With the toy accessory included the line can be more easily held and is less likely to become snarled. If constructed with a substantially longer strap 18, sufficient to wrap around the fisherman's wrist, the fisherman's hand is freed up for landing the fish or other purposes.

In FIG. 7 two of the toy accessories, each generally denoted by 16, are shown attached to separate fingers 40 and 42 on the same hand. The lines 12 may be connected to a model race car or model airplane. The pair of toy accessories are here used in substitution for a dual line control handle and permit a more sensitive control of the toy. The swivels prevent wind-up of the individual lines as the toy circles about the operator.

The swivels disclosed above prevent wind-up of the string and in combination with the relatively wide strap prevent pinching and the attendant discomfiture with long periods of use.

I claim:

1. A finger ring comprising a flexible strap, having first and second portions, one of said portions having a plurality of hooks and the other portion having a plurality of loops adapted to engage said hooks to form an adjustable loop, a cup attached to the strap and having the cup bottom extending outwardly from the strap, a hole formed in the bottom of the cup, the hole having a substantially conical configuration with the larger portion of the cone being located furtherest from the strap, the inner portion of the cone being rolled, the hole being sized to allow passing of a string therethrough and the cup being sized to retain a knot formed in the string within the cup and away from the strap the knot being free to rotate within the cup to form a swivel.

2. The finger ring of claim 1 wherein the hooked portion and looped portion have an aperture with the cup passing therethrough to permanently join the portions together.

3. A finger ring comprising a flexible strap having first and second portions, one of said portions having a plurality of hooks and the other portion having a plurality of loops adapted to engage said hooks to form an adjustable loop, a ring of rigid material permanently attached to the strap and extending outwardly therefrom the rigid ring including a hole extending through the side of the ring opposite from the attachment to the flexible strap, the hole having a substantially conical configuration with the larger portion of the cone being located furthest from the strap and the inner portion being rolled, the ring and hole being sized to allow passing of a string therethrough the ring and hole being sized to retain a knot formed in the string and within the ring and away from the strap the knot being free to rotate within the ring to form a swivel.

* * * * *